US010487435B2

(12) United States Patent
Snook et al.

(10) Patent No.: US 10,487,435 B2
(45) Date of Patent: Nov. 26, 2019

(54) TUB FOR A LAUNDRY WASHING MACHINE

(71) Applicant: Midea Group Co., Ltd., Foshan (CN)

(72) Inventors: Bryan T. Snook, Louisville, KY (US); Christopher G. Hoppe, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 177 days.

(21) Appl. No.: 15/467,768

(22) Filed: Mar. 23, 2017

(65) Prior Publication Data

US 2018/0274162 A1 Sep. 27, 2018

(51) Int. Cl.

*D06F 37/26* (2006.01)
*D06F 37/04* (2006.01)
*D06F 39/00* (2006.01)

(52) U.S. Cl.

CPC ..... *D06F 37/269* (2013.01); *D06F 37/04* (2013.01); *D06F 39/005* (2013.01); *D06F 37/263* (2013.01); *D06F 37/264* (2013.01)

(58) Field of Classification Search

CPC .... D06F 37/262; D06F 37/263; D06F 37/264; D06F 37/269

See application file for complete search history.

(56) References Cited

U.S. PATENT DOCUMENTS 5,373,715 A 12/1994 Sharp et al.
5,746,070 A 5/1998 Bailey et al.
6,148,647 A 11/2000 Kabeya et al.
6,918,271 B2 7/2005 Lim et al.
7,862,871 B2 1/2011 Caudevilla et al.
8,402,797 B2 3/2013 Kim et al.
8,590,347 B2 11/2013 Mola et al.
8,621,896 B2 1/2014 Kim et al.
8,650,918 B2 2/2014 McMaster et al.
8,677,788 B2 3/2014 Kim et al.
8,677,789 B2 3/2014 Gracia Bobed et al.
8,756,957 B2 6/2014 Kim et al.
8,931,312 B2 1/2015 Chang et al.
9,212,447 B2 12/2015 Borque Marquina et al.
9,284,676 B2 3/2016 Choi et al.
9,376,767 B2 6/2016 Quandt et al.
9,394,642 B2 7/2016 McMaster et al.
9,447,534 B2 9/2016 Song et al.

(Continued)

FOREIGN PATENT DOCUMENTS

CN 1274782 A 11/2000
CN 1966818 A 5/2007

(Continued)

OTHER PUBLICATIONS

International Search Report and Written Opinion issued in Application No. PCT/CN2017/102137 dated Dec. 28, 2017.

(Continued)

*Primary Examiner* — Marc Lorenzi
(74) *Attorney, Agent, or Firm* — Middleton Reutlinger

(57) ABSTRACT

A wash tub apparatus and method of manufacturing the wash tub for a laundry washing machine. The wash tub may include an interior rear wall and an exterior rear wall. The exterior rear wall may be molded with a portion of a side wall.

8 Claims, 4 Drawing Sheets

(56) References Cited

U.S. PATENT DOCUMENTS

| | | | | |
|---|---|---|---|---|
| 2002/0194884 | A1* | 12/2002 | Heyder | B39C 45/14336 68/140 |
| 2005/0138971 | A1 | 6/2005 | Ozturk et al. | |
| 2007/0068199 | A1 | 3/2007 | Dahlmann et al. | |
| 2007/0074542 | A1* | 4/2007 | Kim | D06F 37/20 68/3 R |
| 2007/0125135 | A1 | 6/2007 | Kim et al. | |
| 2008/0110213 | A1 | 5/2008 | Choi et al. | |
| 2008/0178635 | A1 | 7/2008 | Ratfisch | |
| 2009/0113941 | A1 | 5/2009 | Kim | |
| 2010/0192640 | A1* | 8/2010 | Gracia Bobed | D06F 37/262 68/212 |
| 2010/0287995 | A1 | 11/2010 | Mancini et al. | |
| 2011/0113833 | A1 | 5/2011 | Borque Marquina et al. | |
| 2012/0007481 | A1 | 1/2012 | Filippetti et al. | |
| 2012/0011899 | A1* | 1/2012 | Kwon | D06F 25/00 68/140 |
| 2012/0240637 | A1* | 9/2012 | Lim | D06F 37/20 68/140 |
| 2015/0322614 | A1 | 11/2015 | Borlin et al. | |
| 2016/0177487 | A1 | 6/2016 | Erickson et al. | |
| 2018/0080161 | A1* | 3/2018 | Fricke | D06F 37/264 |
| 2018/0327957 | A1 | 11/2018 | Kim et al. | |

FOREIGN PATENT DOCUMENTS

| | | | | |
|---|---|---|---|---|
| CN | 101608389 | A | 12/2009 | |
| CN | 101903582 | A | 12/2010 | |
| CN | 204803593 | U | 11/2015 | |
| DE | 1885212 | U | 1/1964 | |
| EP | 0219115 | B1 | 10/1996 | |
| EP | 1538252 | A1 | 6/2005 | |
| EP | 1715096 | B1 | 7/2008 | |
| EP | 2248936 | A1 | 11/2010 | |
| EP | 1881100 | B1 | 1/2011 | |
| EP | 2460924 | A2 | 6/2012 | |
| EP | 3067457 | A1 | 9/2016 | |
| GB | 2157326 | A | 10/1985 | |
| GB | 2189511 | A * | 10/1987 | D06F 37/262 |
| KR | 20080072189 | A | 8/2008 | |

OTHER PUBLICATIONS

International Search Report and Written Opinion issued in Application No. PCT/CN2017/102129, dated Nov. 29, 2017.

U.S. Patent and Trademark Office, Restriction issued in related U.S. Appl. No. 15/467,569 dated Feb. 8, 2019.

* cited by examiner

TUB FOR A LAUNDRY WASHING MACHINE

CROSS-REFERENCE TO RELATED APPLICATION

This application is related to the following application, which is filed on even date herewith and assigned to the same assignees as the present application: U.S. patent application Ser. No. 15/467,569 entitled "Tub with Bearing Housing Insert for a Laundry Washing Machine." The disclosure of this application is incorporated by reference herein.

BACKGROUND

The present embodiments relate to a wash tub for a laundry washing machine.

Typical wash tubs are over-molded onto a bearing housing. As a result, the wash tub is preset for a particular configuration and cannot, for example, be adjusted subsequently to one or more different applications. This practice often does not readily accommodate variations, reduces the speed of delivering model changes to the market, and increases retooling costs. Thus, there is a need to streamline manufacture while reducing cost and production time.

SUMMARY

In some embodiments of the invention, for example, a wash tub for a laundry washing machine may include a substantially cylindrical tub comprising an open front, a rear wall, and/or a side wall. In various embodiments, the rear wall may include an exterior rear wall and an interior rear wall. In addition, in some embodiments, the side wall may extend between the open front and the exterior rear wall. Further in some embodiments, the exterior rear wall may define a through opening therein. In some embodiments, the exterior rear wall may have an interior side facing towards the open front and an opposing exterior side. In some embodiments, the wash tub may include a bearing housing having an outer periphery. In various embodiments, the interior rear wall may include reinforcement ribs. Moreover, in various embodiments, the interior rear wall may be overmolded upon the outer periphery of the bearing housing. Further, in some embodiments, the interior rear wall may include an interior side and an opposing exterior side. In various embodiments, the interior side may include the reinforcement ribs. In some embodiments, when the interior side of the interior rear wall faces towards the interior side of the exterior rear wall and the interior rear wall may be coupled to the interior side of the exterior rear wall and the side wall, the bearing housing may be substantially aligned with the through opening of the exterior rear wall.

In some embodiments, the bearing housing may further include one or more bearings. In various embodiments, the reinforcement ribs may include an outer rib section and an inner rib section. Further, in some embodiments, the inner rib section may project for a distance from the interior side of the interior rear wall larger than the outer rib section. Moreover, in some embodiments, the inner rib section may extend longitudinally through the through opening of the exterior rear wall beyond the exterior side of the exterior rear wall. In various embodiments, the inner rib section may include a frusto-conical shape. In addition, in some embodiments, the bearing housing may extend longitudinally through the through opening of the exterior rear wall beyond the exterior side of the exterior rear wall. In various embodiments, the wash tub may include at least one gasket between the interior rear wall and at least one of the exterior rear wall or the side wall. Moreover, in some embodiments, the interior rear wall may include a first step narrowing the interior rear wall in diameter towards the interior side of the interior rear wall. Further, the side wall may include a second step narrowing the side wall in diameter towards the exterior rear wall and may engage the first step of the interior rear wall.

In some embodiments, a wash tub for a laundry washing machine may include a substantially cylindrical tub comprising an open front, a rear wall, and/or a side wall. In various embodiments, the rear wall may include an exterior rear wall and an interior rear wall. Moreover, in some embodiments, the side wall may extend between the open front and the exterior rear wall. In various embodiments, the exterior rear wall may define a through opening therein. In some embodiments, the exterior rear wall may have an interior side facing towards the open front and an opposing exterior side. In various embodiments, the wash tub may include a bearing housing that may have an outer periphery. In some embodiments, the interior rear wall may have reinforcement ribs. Further, in some embodiments, the interior rear wall may be overmolded upon the outer periphery of the bearing housing. In various embodiments, the interior rear wall may include an interior side and an opposing exterior side. Moreover, in some embodiments, the interior side may include the reinforcement ribs. In various embodiments, when the interior side of the interior rear wall may face towards the interior side of the exterior rear wall, an outer periphery of the interior rear wall may be coupled to the side wall, and the reinforcement ribs may be coupled to the interior side of the exterior rear wall, the bearing housing may be substantially aligned with the through opening of the exterior rear wall.

In addition, in various embodiments, the wash tub may include one or more gaskets between the interior rear wall and at least one of the exterior rear wall or the side wall. In some embodiments, the interior rear wall may include a first step narrowing the outer periphery of the interior rear wall in diameter towards the interior side of the interior rear wall. Moreover, in various embodiments, the side wall may include a second step narrowing the side wall of the cylindrical tub in diameter towards the exterior rear wall and may engage the first step of the interior rear wall. In addition, in some embodiments, the bearing housing may further include one or more bearings. In various embodiments, the reinforcement ribs may include a plurality of radial ribs intersecting a plurality of circumferential ribs. In some embodiments, one or more ends of the radial ribs may define the outer periphery of the interior rear wall and may couple to the side wall of the cylindrical tub.

In various embodiments, a method of manufacturing a wash tub for a laundry washing machine may include the step of manufacturing a first pre-product that may have a bearing housing and an interior rear wall with reinforcement ribs. In some embodiments, the interior rear wall may be overmolded to the bearing housing. Moreover, in various embodiments, the method may include manufacturing by injection molding a second pre-product an open front, an exterior rear wall, and/or a side wall extending between the open front and the exterior rear wall. In some embodiments, the exterior rear wall may define a through opening therein. In various embodiments, the method may include inserting the first pre-product through the open front of the second pre-product towards and into engagement with the exterior rear wall. In addition, in some embodiments, the method may include welding the interior rear wall of the first pre-product to the second pre-product.

In addition, in some embodiments, the method may include inserting one or more gaskets between the interior rear wall of the first pre-product and at least one of the side wall or the exterior rear wall of the second pre-product. In various embodiments, the bearing housing may include one or more bearings. Moreover, in some embodiments, the method may include installing a wash drum into engagement with the wash tub. In various embodiments, the method may include installing the wash tub into the laundry washing machine. In some embodiments, the method of welding the interior rear wall of the first pre-product to the second pre-product may include welding the interior rear wall to at least one of the side wall or the exterior rear wall of the second pre-product.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used as an aid in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques within a front-load residential laundry washing machine 10, such as the type that may be used in single-family or multi-family dwellings, or in other similar applications. However, it will be appreciated that the herein-described apparatus and techniques may also be used in connection with other types of laundry washing machines in some embodiments. For example, they may be used in commercial applications in some embodiments. Moreover, the herein-described apparatus and techniques may be used in connection with other laundry washing machine configurations. For example, a top-load laundry washing machine that includes a top-mounted door in a cabinet or housing that provides access to a vertically-oriented wash tub housed within the cabinet or housing may be used. Implementation of the herein-described apparatus and techniques within a top-load laundry washing machine would be well within the abilities of one of ordinary skill in the art having the benefit of the instant disclosure, so the invention is not limited to the front-load implementation discussed further herein.

Figure 1:
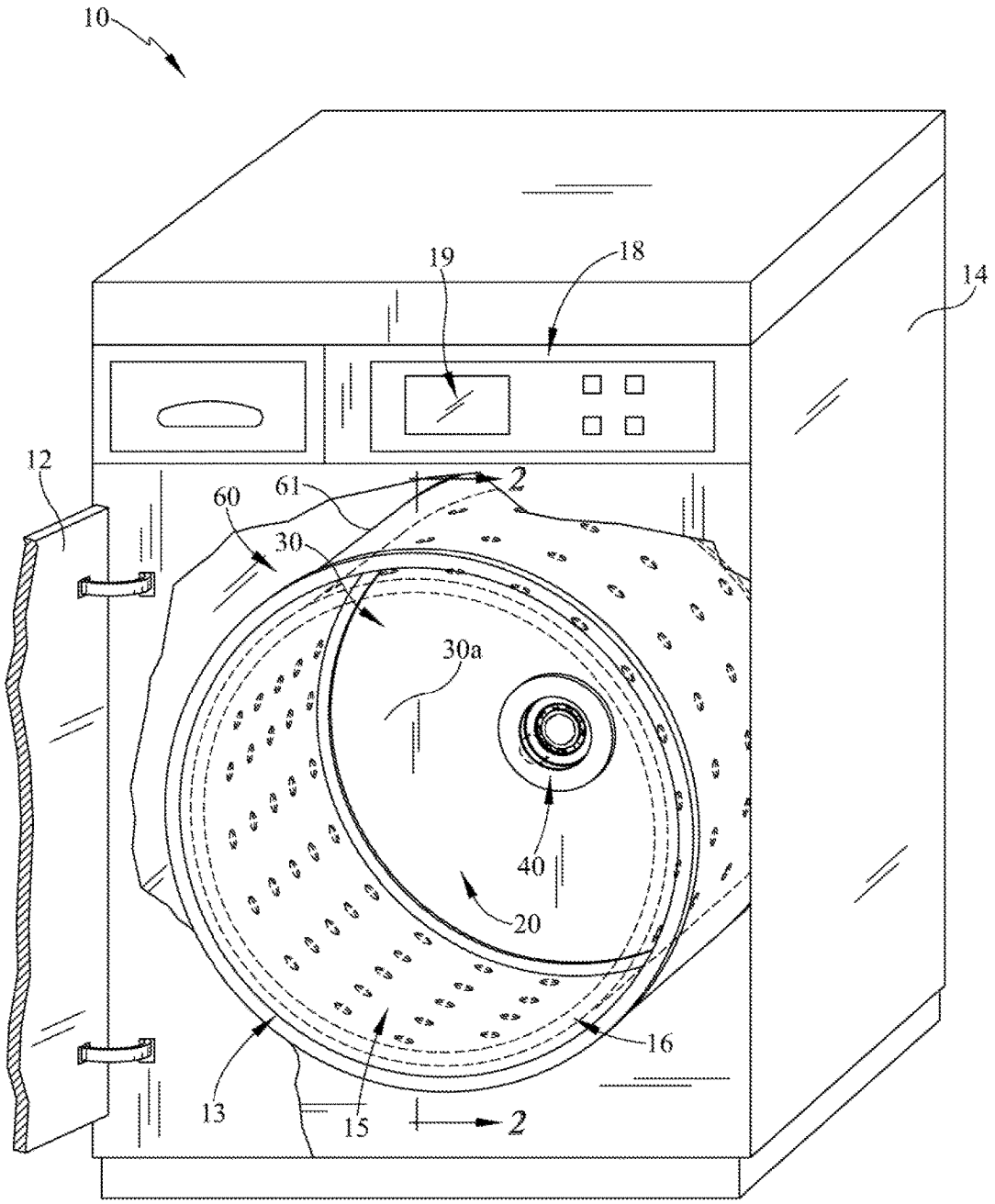
FIG. 1 is a perspective view of one embodiment of a wash tub with portions of an embodiment of the laundry washing machine broken away, illustrating the wash drum in broken lines.

Turning now to the drawings, wherein like numbers denote like parts throughout the several views, FIG. 1 illustrates an example laundry washing machine 10 in which the various technologies and techniques described herein may be implemented. Laundry washing machine 10 is a front-load washing machine, and as such includes a front-mounted door 12 in a cabinet or housing 14 defining an opening 13 that provides access to a horizontally-oriented wash drum or basket 16 and wash tub 20 housed within the cabinet or housing 14. Door 12 is generally hinged along a side or front edge and is pivotable between the open position illustrated in FIG. 1 and a closed position (not shown). When door 12 is in the open position, clothes and other washable items may be inserted into and removed from the wash chamber 15 within the wash drum 16 (shown in broken lines) through the opening 13 in the front of cabinet or housing 14. The wash tub 20 houses the wash drum 16 that includes a plurality of perforations 11. In some embodiments, a drive mechanism rotates the wash drum 16 via a trunnion 17 relative to the wash tub 20, wherein a liquid may be circulated within the wash tub 20, and thereby the wash drum 16, with an amount of liquid to at least partially submerge the fabric load. Rotation of the wash drum 16 imparts mechanical energy to the liquid and to the fabric articles to move the articles within the wash chamber. The wash chamber 15 defines a wash capacity or volume.

Control over the laundry washing machine 10 by a user is generally managed through a control panel 18. The control panel 18 may be disposed on one or more surfaces of the machine 10 and implementing a user interface 19. It will be appreciated that in different washing machine designs, control panel 18 may include various types of input and/or output devices, including various knobs, buttons, lights, switches, textual and/or graphical displays, touch screens, etc. through which a user may configure one or more settings or cycles.

As is shown in the figures, an embodiment of the cylindrical tub 22 of the wash tub 20 may be manufactured by at least two injection molding steps. The manufacturing of the wash tub 20 may include at least a first pre-product 100 and a second pre-product 105. The first pre-product 100 may include at least an interior rear wall 30. The second pre-product 105 may include at least an exterior rear wall 50 and/or side wall 60. When joined (e.g. welding), the interior rear wall 30 and exterior rear wall 50 define at least a portion of the rear wall 23 and/or cylindrical tub 22 closing the end opposite the open front 64 of the wash drum 20. The use of a variety of components to create the rear wall 23 may allow the characteristics (e.g. rear wall stiffness) of one or more of the components to be varied depending on the application. For example, the mold for the interior rear wall 30 that is overmolded to the bearing housing 40 may be more flexible to change and still match an inner periphery 61 of the side wall 60 and/or exterior rear wall 50. Moreover for example, different rib reinforcement 80 patterns, depths, of the like may be used in the first pre-product 100 depending on the design load requirements and used in the same second pre-product 105, or a variety of different second pre-products. Moreover in some embodiments, this may be advantageous to reduce tooling costs, self-align parts, and speed up the process of introducing new models with different dynamic loading specifications to the market.

Figure 3:
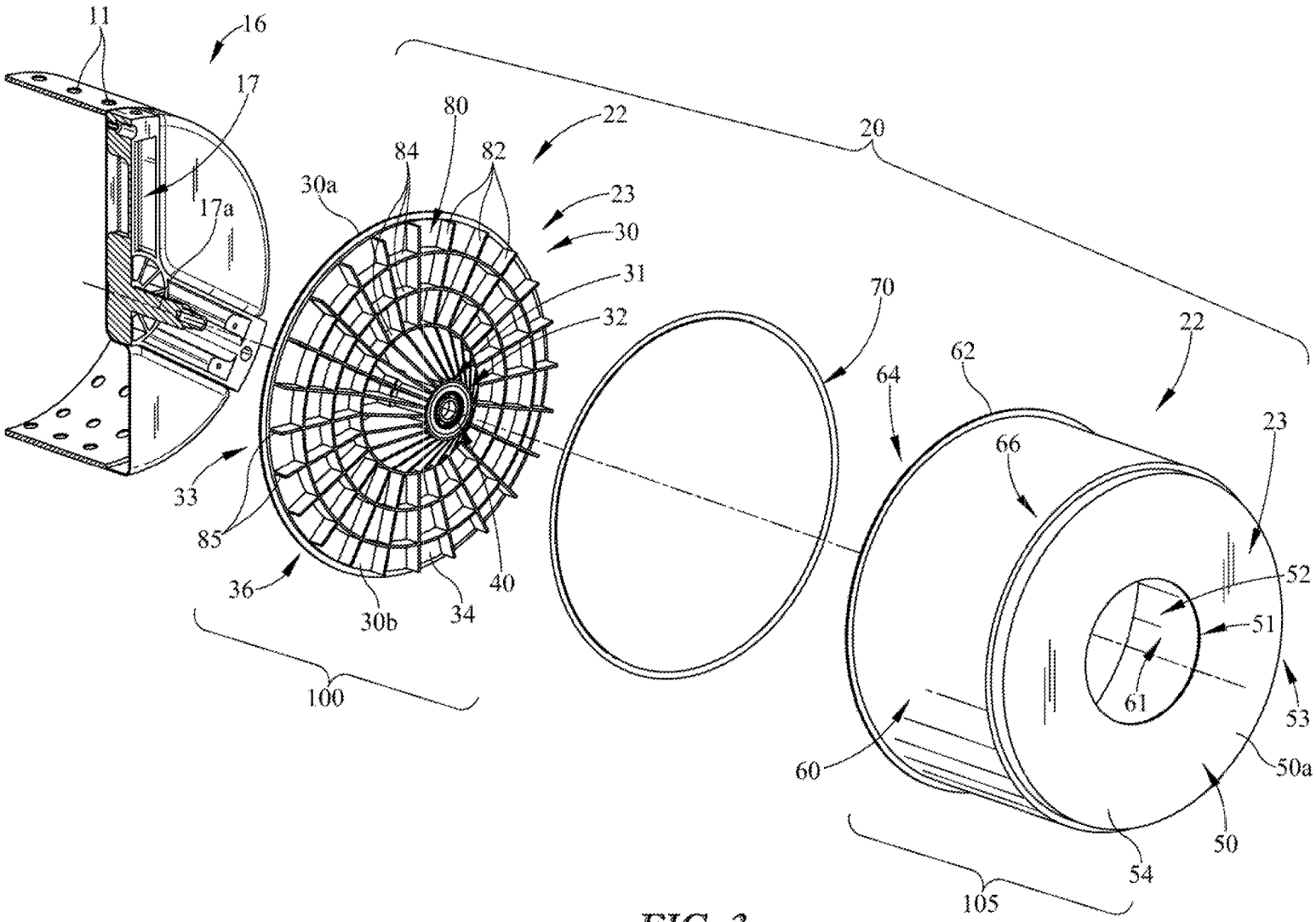
FIG. 3 is an exploded, perspective view of one embodiment of the wash tub of FIG. 1 along with a section view of the wash drum, illustrating the interior rear wall overmolded on the bearing housing exploded from the exterior rear wall and side wall.

As best illustrated in FIG. 3, the first pre-product 100 may be manufactured for making the wash tub 20. In some embodiments, the first pre-product 100 may include the bearing housing 40 and overmolded interior rear wall 30 of the plastic cylindrical tub 22. The interior rear wall 30 may be injection molded about the bearing housing 40. A variety of surfaces and/or one or more components of the bearing housing 40 may be in contact or coupled with the injected plastic. In the one embodiment shown, portions of the outer periphery 44 may be coupled to the injected interior rear wall 30. It should be understood that the interior rear wall 30 may be molded to a variety of bearing housing embodiments or portions thereof to create a variety of first pre-products 100. For example, one embodiment of the first pre-product may include an interior rear wall 30 overmolded on a portion of the bearing housing and/or a bearing housing shell, such as described in U.S. patent application Ser. No. 15/467,569, the disclosure of which is incorporated by reference herein. As such the bearing housing and/or bearing housing shell of an embodiment of the first pre-product may have one or more portions of the bearing housing, bearing housing insert, and/or bearings subsequently assembled therewith, before and/or after assembly with a second pre-product. Although an embodiment of the interior rear wall 30 is shown in the figures, it should be understood that the interior rear wall may be of a variety of shapes, sizes, quantities, and constructions.

As further illustrated in FIG. 3, the second pre-product 105 may be manufactured for making a portion of the wash tub 20. In some embodiments, the second pre-product 105 may include at least the side wall 60 and/or exterior rear wall 50 of the cylindrical tub 22. In the one embodiment shown of the second pre-product 105, at least a portion of the side wall 60 may be injected molded with the exterior rear wall 50 of the plastic tub 22. Although an embodiment of the exterior rear wall 50 and/or side wall 60 is shown in the figures, it should be understood that the exterior rear wall and/or side wall may be of a variety of shapes, sizes, quantities, and constructions.

If used as illustrated in FIG. 3, one or more gaskets 70 may be used between the first pre-product 100 and the second pre-product 105. It should be understood in some embodiments, the first pre-product 100 and/or the second pre-product 105 may include the one or more gaskets 70. Although an embodiment of the gasket 70 is shown in the figures, it should be understood that the gasket may be of a variety of shapes, sizes, quantities, and constructions. For example, a plurality of gaskets may be used in a variety of different positions between the components of the wash tub 20.

Figure 2:
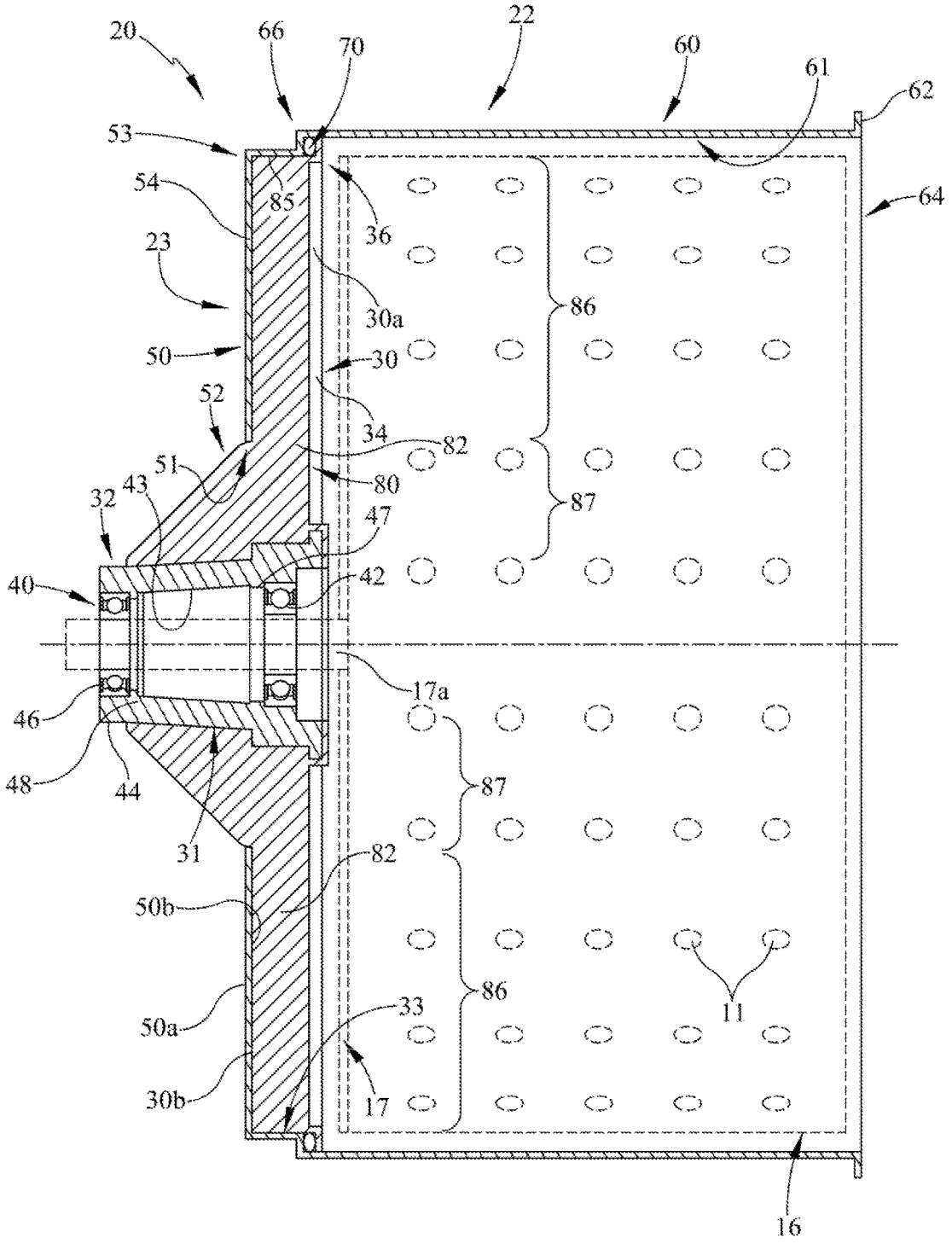
FIG. 2 is a side section view of the wash tub of FIG. 1 taken along line 2-2, illustrating the wash drum in broken lines.
Figure 4:
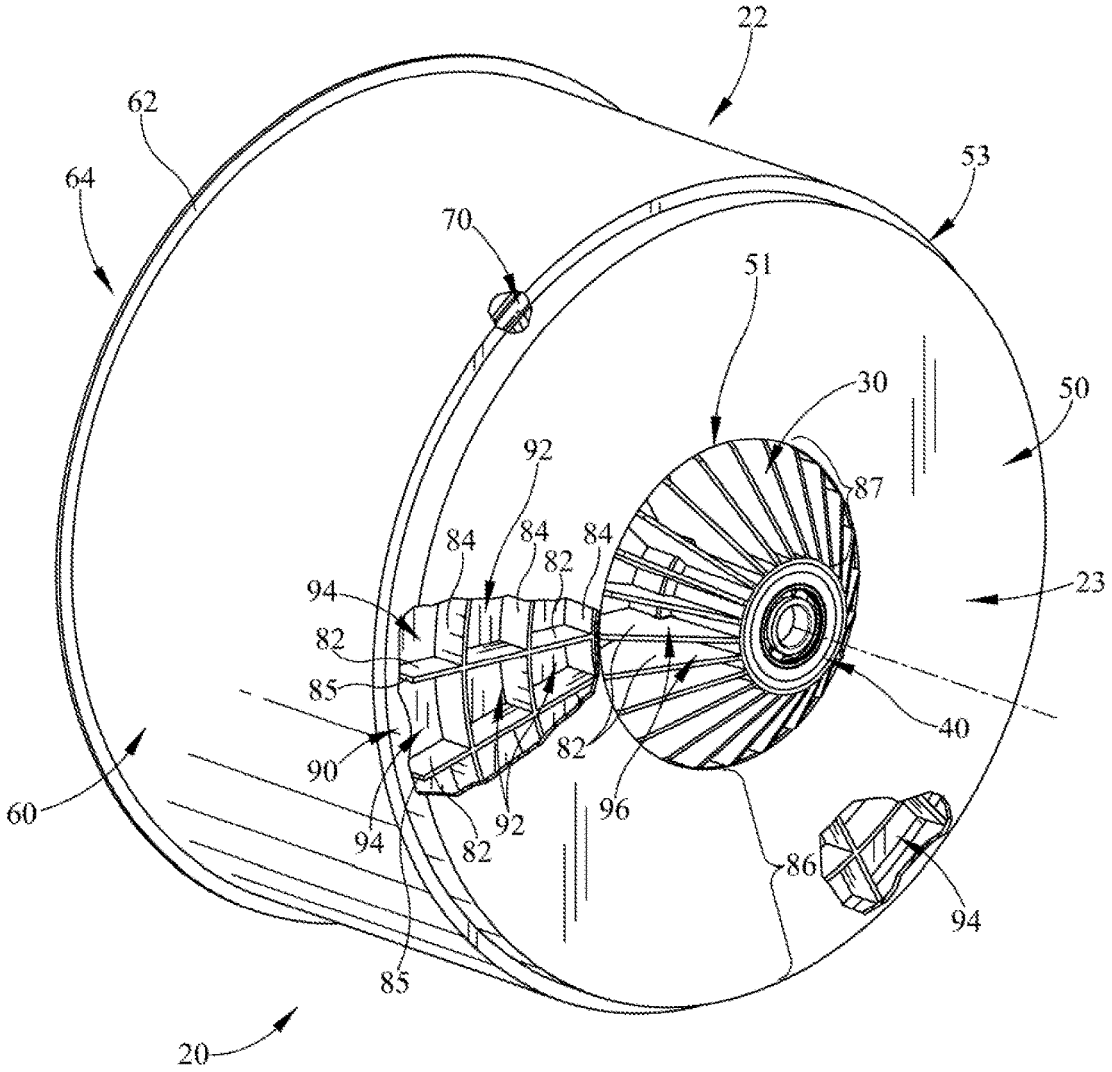
FIG. 4 is a perspective view of the wash tub of FIG. 1 with portions of the wash tub broken away.

FIGS. 1, 2, and 4 illustrate one embodiment of an assembled wash tub 20 having at least the plastic cylindrical tub 22 with a bearing housing 40 to position the rotatable wash drum 16 therein. The wash tub 20 includes one embodiment of the cylindrical tub 22 to support the drive shaft 17*a* of the trunnion 17 extending through a rear wall 23 of the plastic cylindrical tub 22. The cylindrical tub 22 or portions thereof may be made from a variety of materials, such as but not limited to, plastic. For example, a portion of the material may be a thermoplastic material in various embodiments such as polypropylene. Although an embodiment of the cylindrical tub 22 is shown in the figures, it should be understood that the cylindrical tub 22 may be of a variety of shapes, sizes, quantities, and constructions. For example, the interior rear wall 30 may be a material different or the same as the remaining portion of the cylindrical tub (e.g. side wall 60 and/or exterior rear wall 50)

As best illustrated in FIGS. 2 and 4, one embodiment of the rear wall 23 of the cylindrical tub 22 may include an interior rear wall 30 radially overlapping an exterior rear wall 50. The interior rear wall 30 overlaps from an outer periphery 53 of the exterior rear wall 50 to an inner periphery 51 of the exterior rear wall 50 in some embodiments. In various embodiments of the exterior rear wall 50, the inner periphery 51 of the exterior rear wall may define a first through opening 52. When the outer periphery 33 of the interior rear wall 30 corresponds to and engages the inner periphery 61 of the side wall 60 and/or the exterior rear wall 50, the interior rear wall 30 axially or substantially aligns the bearing housing 40 with the first through opening 52 of the exterior rear wall 50. In some embodiments, this may be advantageous for centering or self-aligning parts.

In some embodiments, the exterior rear wall 50 may be molded with a portion of the side wall 60 of the cylindrical tub 22. The substantially cylindrical tub 22 of the second pre-product 105 may include an open front 64 and an opposing exterior rear wall 50 with a side wall 60 extending between the open front 64 and the exterior rear wall 50. The exterior rear wall 50 may include an exterior side 50*a* and an interior side 50*b*. In various embodiments, the exterior rear wall 50 may include a disc shaped body or member 54. The inner periphery 51 of the body 54 and/or exterior rear wall 50 may define the first through opening 52. The body 54 may define the first through opening 52 extending between the interior side 50*b* and the exterior side 50*a*. The side wall 60 may project from the outer periphery 53 of the exterior rear wall 50 and/or body 54 from the interior side 50*b* of the exterior rear wall 50. A distal end 62 of the side wall 60 opposite the exterior rear wall 50 may define the open front 64 of the cylindrical tub 22. The side wall 60 includes an inner periphery 61 having one or more diameters or a substantially cylindrical shape. The side wall 60 may include a step or tier 66 increasing the inner periphery 61 in diameter towards the open front 64 in some embodiments. Alternatively stated, the step 66 may narrow the side wall 60 in diameter towards the exterior rear wall 50.

In various embodiments, the interior rear wall 30 of the cylindrical tub 22 may be overmolded onto a variety of bearing housing 40 embodiments. At least a portion of the bearing housing 40 may be formed as a unit with the cylindrical tub 22 by inserting material in the injection molding of the tub of plastic about the bearing housing 40. The interior rear wall 30 positions the bearing housing 40 within a second through opening 32 corresponding to the overmolded bearing housing 40. The interior rear wall 30 may be overmolded or coupled to one or more surfaces or portions of the bearing housing 40. In the one embodiment shown, the interior rear wall 30 may be overmolded upon the outer periphery 44 of the bearing housing 40. The interior rear wall 30 may include an exterior side 30*a* and an interior side 30*b*, with the interior side 30*b* facing towards the exterior rear wall 50 when assembled. In various embodiments, the interior rear wall 30 may include a disc shaped body or member 34. The body 34 defines the second through opening 32 at an inner periphery 31 molded to the bearing housing 40.

The interior rear wall 30 and/or the exterior rear wall 50 may include one or more reinforcement ribs 80 (e.g. positioned on one or both interior sides 30*b*, 50*b* of the rear wall 23). In the one embodiment shown, the interior rear wall 30 may include one or more reinforcement ribs 80. The reinforcement ribs 80 may project from the interior side 30*b* and/or body 34 of the interior rear wall 30. The reinforcement ribs 80 may be a variety of patterns, shapes, sizes, quantities, and construction. As illustrated in FIGS. 2-4, one embodiment of the reinforcement ribs 80 may include radial ribs 82 and/or circumferential ribs 84. As shown in the one embodiment, the radial ribs 82 and circumferential ribs 84 may intersect with each other across the body 34. In other embodiments, portions of the radial ribs and circumferential ribs may not intersect each other. The one or more radial ribs 82 may extend for a variety of distances and positions between the inner periphery 31 towards the outer periphery 33 of the interior rear wall 30 at one or more radial positions about the longitudinal axis of the second through opening 32. The one or more circumferential ribs 84 may be positioned around the longitudinal axis at one or more diameters. In the one embodiment shown of the interior side 30*b* of the interior rear wall 30, a circumferential rib 84 may not be included adjacent the outer periphery 33 of the interior rear wall 30. As a result, the outer periphery 33 may include one or more ends 85 of the radial ribs 82 spaced from each other. When the rear wall 23 is assembled, the ends 85 of the radial ribs 82 may define a portion of the outer periphery 33 and engage or couple with the side wall 60 of the cylindrical tub 22.

It is understood that the engagement between the interior rear wall 30 (e.g. outer periphery 33 and/or interior side 30*b*) and corresponding inner periphery 61 of the side wall 60 and/or exterior rear wall 50 may be of a variety of shapes, quantities, sizes, construction, and still couple with each other. As shown in the one embodiment, the inner periphery 61 of the side wall 60 of the cylindrical tub 22 may correspond to or be substantially the same diameter as the outer periphery 33 of the interior rear wall 30. As shown in the one embodiment of FIG. 2, the outer periphery 33 of the interior rear wall 30 may include a step or tier 36 corresponding to the step 66 and/or inner periphery 61 of the side wall 60. The step 36 of the interior rear wall 30 may narrow in diameter towards the interior side 30*b* of the interior rear wall 30. In various embodiments, the portion of the step 36 at the outer periphery 33 having the smaller diameter may include the ribs (e.g. radial ribs 82, radial ribs ends 85, and/or circumferential ribs 84). In the one embodiment shown, the radial ribs (e.g. spaced apart radial ribs or ends 85) define a portion of the outer periphery 33 having the narrowed diameter defining the step 36. If a step 36 is used, the outer periphery 33 defining the step may be a variety of shapes, sizes, quantities, and constructions.

The reinforcement ribs 80 may be a variety of configurations in one or more embodiments of the interior rear wall 30. As shown in the figures, one embodiment of the reinforcement ribs 80 may include an outer rib section 86 and an inner rib section 87. The inner rib section 87 may extend from adjacent the second through opening 32 or inner periphery 31 (e.g. a first annular shape). The outer rib section 86 may extend from the inner rib section 87 to the outer periphery 33 of the interior rear wall 30 (e.g. a second annular shape). The outer rib section 86 may project for a distance less than the inner rib section 87 from the interior side 30*b* of the interior rear wall 30. The inner rib section 87 and/or bearing housing 40 may be received within the first through opening 52 of the exterior rear wall 50. The inner rib section 87 and/or bearing housing 40 may extend longitudinally through the first through opening 52 of the exterior rear wall 50 beyond or past the exterior side 50*a* of the exterior rear wall 50. The inner periphery 51 of the exterior rear wall 50 may be adjacent the transition between the inner rib section 87 and outer rib section 86. In the one embodiment as shown, the inner rib section 87 may be described as frusto-conical in shape. The outer rib section 86 may be overlapped with the body 34 of the interior rear wall 30 and the body 54 of the exterior rear wall 50. Moreover, the inner rib section 87 may include radial ribs 82 without circumferential ribs 84 as shown in the one embodiment. However, circumferential ribs 84 may be used in the inner rib section 87. The outer rib section 86 may include both radial ribs 82 and circumferential ribs 84 as shown, however one or the other may be used in some embodiments.

In some embodiments as shown in FIG. 4, the rear wall 23 may include one or more boxes 90. The boxes may be defined by one or more of the radial ribs, one or more of the circumferential ribs, body 34, body 54, and/or side wall 60. The boxes 90 may be substantially closed or open in various embodiments. For example, one or more boxes 90 may be defined within the outer rib section 86 and/or inner rib section 87. In the one embodiment shown, the outer rib section 86 defines one or more boxes 92, 94. When the rear wall 23 is assembled, two adjacent radial ribs 82, two adjacent circumferential ribs 84, and opposing bodies 34 and 54 may define one embodiment of the substantially enclosed box 92. Another embodiment of the substantially enclosed box 94 may be adjacent the outer periphery 33 of the interior rear wall 30 when assembled with the exterior rear wall 50 and may be defined by two adjacent radial ribs 82, the side wall 60, and the opposing bodies 34 and 54. As shown in the inner rib section 87 of FIG. 4, it should be understood that one or more substantially open boxes 96 may be used in some embodiments. The open boxes 96 may not use the exterior rear wall body 54 to enclose the radial ribs 82 and/or circumferential ribs 84 with the interior rear wall body 34.

As illustrated in FIGS. 2-4, one embodiment of the bearing housing 40 may be overmolded by the interior rear wall 30. In the one embodiment shown, the bearing configuration may include a front bearing 42 and a rear bearing 46 fitted into the inner periphery 43 or circumference of a front step 47 and a rear step 48, respectively, to receive the rotating drive shaft 17*a* coupled to the wash drum 16. The bearing housing 40 may be of a variety of materials, such as but not limited to metal, polymers, ceramics, etc. One example of the metallic material that may used in some embodiments is cast iron. Although an embodiment of the bearing housing 40 is shown in the figures, it should be understood that the bearing housing 40 may be of a variety of shapes, sizes, quantities, and constructions.

In some embodiments, one or more gaskets 70 may be used between the interior rear wall 30 and the exterior rear wall 50 and/or side wall 60 to seal the engagement between the first pre-product 100 and the second pre-product 105. Although one embodiment of the gasket 70 is shown as an O-ring, a variety of gaskets my be used. If used, one or more gaskets 70 may seal the first pre-product 100 with the second pre-product 105. As shown in the one embodiment, the O-ring may be axially and/or radially compressed. The O-ring or gasket may be radially compressed between the outer periphery 33 of the interior rear wall 30 and the inner periphery 61 of the side wall 60. Moreover, the O-ring or gasket may be axially compressed between the interior side 30*b* of the interior rear wall 30 and the inner periphery 61 of the side wall 60 as shown. Alternatively in some embodiments, the gasket may be compressed between the interior rear wall 30 and the exterior rear wall 50. In the one embodiment shown, the gasket may be positioned at or between the corresponding steps 36 and 66. Although an embodiment of the gasket is shown in the figures as a single O-ring, it should be understood that the gasket may be of a variety of shapes, sizes, quantities, and constructions and positioned at a variety of positions between the components of the cylindrical tub 22.

As shown in figures, an assembled wash tub 20 according to one embodiment of the invention includes the first pre-product 100 and the second pre-product 105. Assembling the first pre-product 100 and the second pre-product 105 may include joining the exterior rear wall 50 of the second pre-product 105 with the interior rear wall 30 of the first pre-product 100. If used, the one or more gaskets 70 may be positioned or inserted therebetween during assembly and/or coupled with one or both of the first pre-product 100 and the second pre-product 105 before assembling. The first pre-product 100 and/or interior rear wall 30 may be inserted through the open front 64 of the second pre-product 105 towards and into engagement with the second pre-product 105 (e.g. the side wall 60 and/or the exterior rear wall 50). When the interior side 30*b* of the interior rear wall 30 faces towards the interior side 50*b* of the exterior rear wall 50, the interior rear wall 30 may be coupled to the interior side 50*b* of the exterior rear wall 50 and/or the inner periphery 61 of the side wall 60. Moreover the gasket 70, if used, may be compressed to seal between the components (e.g. axially and/or radially between the first and second pre-products). In the one embodiment, the outer periphery 33 of the interior rear wall 30 corresponds to the inner periphery 61 of the side wall 60 and/or exterior rear wall 50. In some embodiments, when assembled the reinforcement ribs 80 (e.g. radial and/or circumferential ribs) of the first pre-product 100 may be coupled with the side wall 60 and/or exterior rear wall 50. The first pre-product 100 and/or interior rear wall 30 may be welded once in position with the second pre-product 105. However, it is contemplated a variety of methods and materials may be used to assemble (e.g. adhesive, pressed, screw, etc). In some embodiments, the interior rear wall 30 may be welded to the side wall 60 and/or the exterior rear wall 50 of the second pre-product 105. As shown in FIGS. 1-4, the first and/or second pre-products 100 and 105 of the wash tub 20 may be stocked and/or further combined with or installed into the wash drum 16 and/or the laundry washing machine housing 14.

Moreover as should be understood, the first pre-product 100 and/or the second pre-product 105 may be stocked and/or used directly in the laundry washing machine or assembly 10 in some embodiments. With a variety of second pre-products 105 stocked, one embodiment of the first pre-product 100 may be molded for a particular application for, but is not limited to, one or more configurations of bearings and/or bearing housing, reinforcement rib configuration, rear wall stiffness, adjust the available water in the wash drum, and load characteristics depending on the particular application. Moreover, one or more embodiments of the first pre-product 100 may have a different configuration of bearings and/or bearing housing for another or different sized drive shaft 17*a*.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A wash tub for a laundry washing machine comprising:

a cylindrical tub comprising an open front, a rear wall, and a side wall, wherein the rear wall includes an exterior rear wall and an interior rear wall;

wherein the exterior rear wall and the side wall are molded together in a first pre-product, wherein the side wall extends between the open front and the exterior rear wall, wherein the exterior rear wall defines a through opening therein, and the exterior rear wall has an interior side facing towards the open front and an opposing exterior side, and the side wall includes an inner periphery;

a bearing housing having an outer periphery;

the interior rear wall includes reinforcement ribs, wherein the interior rear wall is overmolded upon the outer periphery of the bearing housing, wherein the interior rear wall includes an interior side and an opposing exterior side, and the interior side of the interior rear wall includes the reinforcement ribs;

wherein the interior rear wall is positioned inside the first pre-product, the interior side of the interior rear wall faces towards the interior side of the exterior rear wall such that the reinforcement ribs of the interior rear wall directly engages to both the interior side of the exterior rear wall and the inner periphery of the side wall, and the bearing housing is aligned with the through opening of the exterior rear wall; and wherein the interior rear wall includes a first step narrowing the interior rear wall in diameter towards the interior side of the interior rear wall, and the side wall includes a second step narrowing the side wall in diameter towards the exterior rear wall and engaging the first step of the interior rear wall.

2. The wash tub of claim 1 wherein the bearing housing further includes one or more bearings.

3. The wash tub of claim 1 wherein the reinforcement ribs include an outer rib section and an inner rib section, wherein the inner rib section projects for a distance from the interior side of the interior rear wall larger than the outer rib section.

4. The wash tub of claim 3 wherein the inner rib section extends longitudinally through the through opening of the exterior rear wall outside the exterior side of the exterior rear wall.

5. The wash tub of claim 3 wherein the inner rib section includes a frusto-conical shape.

6. The wash tub of claim 1 wherein the bearing housing extends longitudinally through the through opening of the exterior rear wall outside the exterior side of the exterior rear wall.

7. The wash tub of claim 1 further comprising at least one gasket between the interior rear wall and at least one of the exterior rear wall or the side wall.

8. The wash tub of claim 1 wherein an outer periphery of the interior rear wall is in direct engagement with and centered with respect to the inner periphery of the side wall.

* * * * *